United States Patent [19]

Plöckinger et al.

[11] 4,027,720

[45] June 7, 1977

[54] METHOD OF PRODUCING HOMOGENOUS INGOTS OF HIGH-MELTING, NITROGEN-CONTAINING ALLOYS

[75] Inventors: Erwin Plöckinger; Otto Daghofer, both of Kapfenberg, Austria; Farouk Barakat, Damaskus, Syria

[73] Assignee: Vereinigte Edelstahlwerke AG, Vienna, Austria

[22] Filed: Feb. 23, 1976

[21] Appl. No.: 660,233

[30] Foreign Application Priority Data

Feb. 25, 1975 Austria ..... 1404/75

[52] U.S. Cl. ..... 164/52; 75/10 C; 164/252

[51] Int. Cl.[2] ..... B22D 7/00; B22D 27/20

[58] Field of Search ..... 164/52, 252; 13/9 ES; 75/10 C

[56] References Cited

UNITED STATES PATENTS

| | | | |
|---|---|---|---|
| 3,203,783 | 8/1965 | Peras et al. | 75/11 |
| 3,282,676 | 11/1966 | Perry et al. | 75/12 |
| 3,344,839 | 10/1967 | Sunnen | 164/52 |
| 3,640,700 | 2/1972 | Suzuki et al. | 75/10 C |
| 3,905,803 | 9/1975 | Bianchi et al. | 75/10 C |
| 3,930,531 | 1/1976 | Frehser et al. | 164/52 |

FOREIGN PATENTS OR APPLICATIONS

| | | | |
|---|---|---|---|
| 870,527 | 5/1971 | Canada | 75/10 C |

*Primary Examiner*—Ronald J. Shore
*Attorney, Agent, or Firm*—Burns, Doane, Swecker & Mathis

[57] ABSTRACT

In a method of producing homogenous ingots of high-melting, nitrogen-containing alloys, whose nitrogen contents are above the solubility limit at atmospheric pressure, according to the electric slag remelting process and using a pressure above atmospheric, a composite electrode consisting of at least one core made of a nitrogen-containing alloy and a jacket made of a nitrogen-containing alloy is used, wherein one of the nitrogen contents is higher and the other one is lower than that of the ingot to be produced.

19 Claims, 3 Drawing Figures

Figure 1:
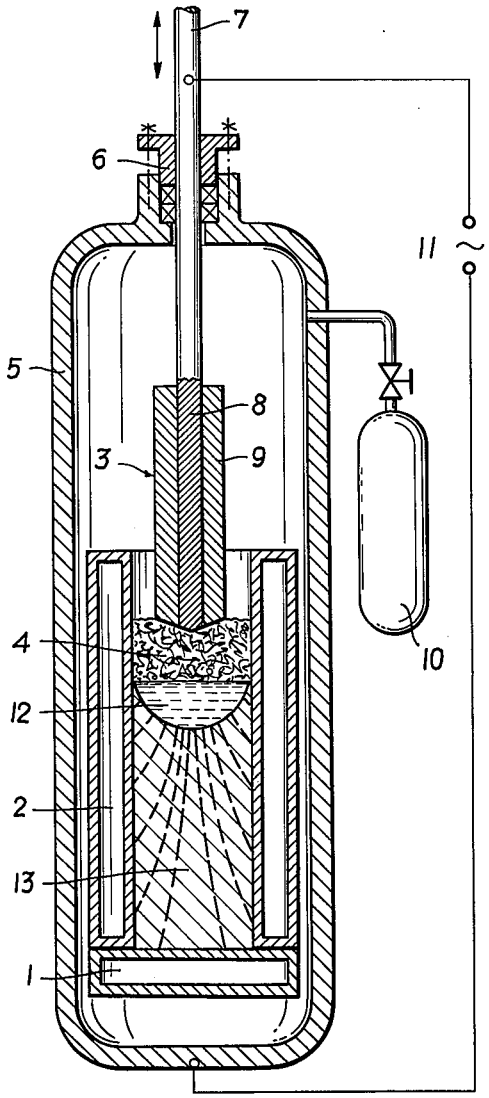

METHOD OF PRODUCING HOMOGENOUS INGOTS OF HIGH-MELTING, NITROGEN-CONTAINING ALLOYS

The invention relates to a method of producing homogenous ingots of high-melting, nitrogen-containing alloys whose nitrogen contents are above the solubility limit at atmospheric pressure, according to the electric slag remelting process.

Since it has been found that the element nitrogen can be used as alloying element and since one has realized the advantages of using nitrogen for instance as austenite-forming and strength-improving element in austenitic steels, various methods of producing steels having a high nitrogen content have been suggested and tested without having been able to apply them on an industrial scale, because of the technical problems existing.

One of the suggestions for introducing nitrogen in concentrations lying above the solubility limit at atmospheric pressure in steels and alloys consists in that these working materials are melted in an induction furnace under the respective nitrogen pressure and that after obtaining the nitrogen solubility equilibrium, the melt is cast under the same nitrogen overpressure and is allowed to solidify. By solidifying under overpressure the otherwise unavoidable separation of gaseous nitrogen in the form of gas bubbles and pores in the cast ingot is avoided when the metal cools off and changes from the liquid to the solid condition. It was, however, impossible to use this method for an economical production of high-nitrogen-alloyed steels because of the high investments necessary for the pressure chambers, the relatively complicated equipment and the high costs of the procedure. A further difficulty consisted in the large amount of liquid metal contained in gas dissolved under pressure; in case of a leak, the metal foams and is pressed through the leak under high pressure.

A further proposal to effect the necessary nitrogen uptake with the help of the electric slag remelting process under nitrogen overpressure during the melting off of the remelting electrode could not be realized due to the poor nitrogen solubility of the common slags used in the electric slag remelting process. The rate of the nitrogen transit from the gaseous phase into the molten metal of the melt sump is too low, compared to the required melting and solidifying rates, to obtain the desired nitrogen contents in the metal and to safeguard the required homogeneity of the nitrogen distribution over the length of the ingot.

It has also been attempted to introduce the nitrogen into the slag, in the electric slag remelting process, by the continuous addition of high-nitrogen-containing ferroalloys under simultaneous nitrogen pressure; these attempts, however, also failed because of the inhomogeneity of the nitrogen and alloy distributions in the produced remelted ingots. This is not only due to the difficulty of obtaining a sufficiently uniform distribution of the alloying additions during the remelting procedure, but also to the fact that the necessarily relatively finely grained alloys quickly melt up while passing through the molten slag having a high temperature, that they emit gaseous nitrogen into the atmosphere and thus uncontrollably influence the nitrogen yield. Because of unavoidable irregularities in the apportioning of the additions also solidifying mixtures of alloying powder and slag form, whereby the remelting procedure is disturbed and inhomogeneities occur in the ingot.

The present invention has the object of eliminating the above described disadvantages and to produce homogenous, high-nitrogen-containing ingots of steels and alloys, whose nitrogen contents lie above the solubility limit at atmospheric pressure in a simple and economical manner.

According to the invention this object is achieved in a process of the above defined kind in that a composite electrode having a core and a jacket is used, wherein the core consists of a high-nitrogen alloy, whose nitrogen content is higher than the nitrogen content of the ingot to be produced and wherein the jacket part consists of an alloy whose nitrogen content is lower than that of the ingot to be produced, and wherein the process is carried out at a pressure that is above atmospheric pressure.

Also more than one core may be used, wherein all the cores or individual ones thereof consist of the alloy richer in nitrogen, or various alloys with and without nitrogen can be used in the individual cores. Furthermore, the alloy being richer in nitrogen can be in the jacket and the one having less nitrogen can be used in one or more than one cores.

Surprisingly, in the remelting of such a composite electrode it has been found that the materials of the core and of the jacket melt off so uniformly that a completely homogenous liquid melt forms in the mould. The mixing occurring already at the melting off area of the composite electrode of the differently alloyed materials, and the dilution in the nitrogen content caused thereby from the concentration in the alloying material rich in nitrogen to the desired nitrogen content in the remelted ingot, together with the protective effect of the remelting slag being under overpressure and having a very poor nitrogen solubility, prevents losses of nitrogen by escape of nitrogen into the furnace atmosphere.

Advantageously, a lime-alumina-fluorspar-slag can be used as remelting slag, if desired having a content of MgO. Suitable systems have 10 to 40% CaO, 15 to 40% $Al_2O_3$, 15 to 75% $CaF_2$ and 0 to 10% MgO. However, also a slag consisting merely of alumina and fluorspar can be used, having about 30% $Al_2O_3$ and 70% $CaF_2$, or merely of lime and fluorspar, having about 20% CaO and 80% $CaF_2$. it is essential for the slag to have only a slight transportability (solubility or diffusability) for nitrogen, so that no nitrogen can escape into the furnace atmosphere.

When such a slag is used, the chemical composition of the furnace atmosphere (pressure gas) is without significance, it is only important that the gas of the furnace atmosphere does not dissolve to an essential extent in the slag (e.g., nitrogen, dry air, argon).

Any kind of current, such as alternating current (having a high or a low frequency) or direct current (any polarity, pulsating or not) can be used as remelting energy.

According to a preferred embodiment of the invention, a composite electrode produced in composite casting is employed. Herein the molten core alloy having a high nitrogen content can be cast into a hollow body consisting of the alloy having a low nitrogen content, or a core of the alloy having a high nitrogen content can be cast around by a jacket of the alloy having the low nitrogen content.

According to another embodiment, the composite electrode is produced by filling the hollow body of the alloy having the low nitrogen content with particles of the alloy having the high nitrogen content and, if desired, sintering this composite electrode. It is also possible to produce the jacket of the composite electrode of individual alloy particles by sintering, wherein, if desired, a sheet casing is placed around the electrode.

The method according to the invention is particularly advantageous when steels are used which contain nitride formers.

According to preferred embodiments of the invention, ingots of austenitic steels having a nitrogen content of between 0.2 and 2% can be produced by using a composite electrode, whose core consists of a chromium and/or manganese nitride having a nitrogen content of between 0.5 and 12.0% (mostly nitrogen-enriched ferro-chromium and/or ferro-manganese) while the jacket contains the remaining elements, also iron and steel companions (furthermore also nickel, molybdenum, tungsten, e.g.), as well as chromium and manganese, insofar as necessary for completing the ingot analysis.

If necessary, further additional elements can be introduced by continuous addition.

This electrode is remelted in a lime-alumina-fluorspar-magnesia-slag system at a pressure of between 6 and 41 bar.

The dimensioning of core and jacket results from the estimation of the materials, taking into consideration the specific gravities.

Figure 2:
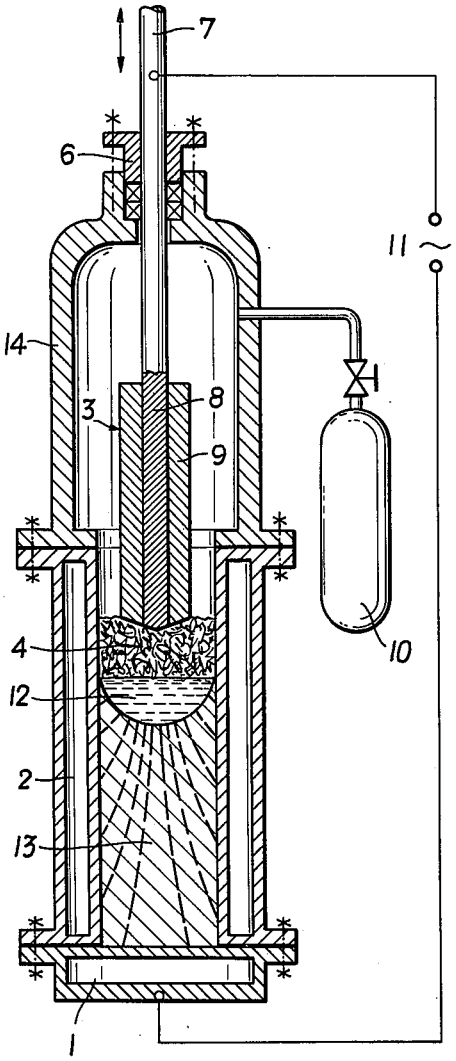
Figure 3:
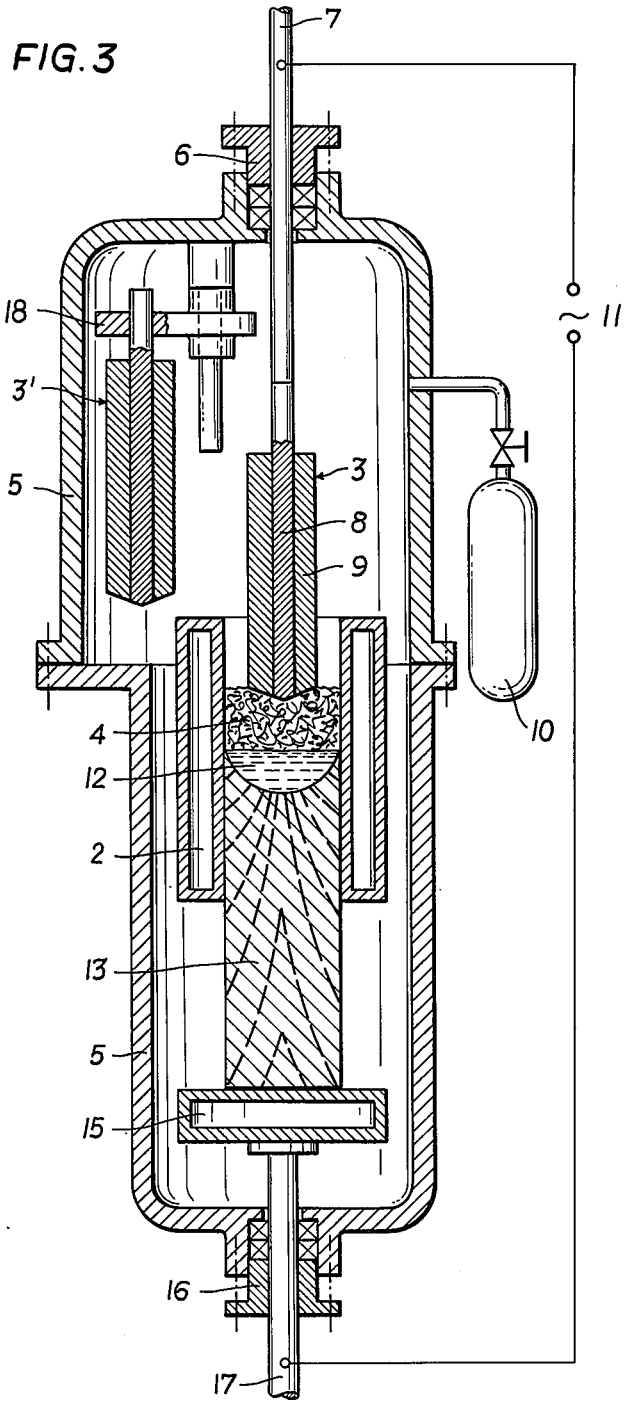

Means for carrying out the process according to the invention shall now be schematically illustrated in more detail and with reference to the accompanying drawings, wherein FIGS. 1 to 3 represent vertical sections.

According to FIG. 1 the electric slag remelting mould has a water-cooled bottom 1 and cooled side walls 2. The electrode 3 immerses into the slag 4 and there it is fused down. Mould and electrode are in a pressure container 5 at whose upper end there is a stuffing box 6 through which the electrode rod 7 is guided. The electrode consists of the nitride core 8 and the steel jacket 9. The pressure container 5 is supplied with gas via the gas source 10. The plant is supplied with energy by the electric energy source 11. By melting off the electrode 3, the sump 12 is formed, and the ingot 13 solidifies.

In the modified embodiment according to FIG. 2, the mould itself simultaneously serves as pressure vessel; it has a water-cooled bottom 1, cooled side walls 2, and is gas-tightly connected with a pressure top 14 through which the electrode rod 7 is guided.

A further embodiment is shown in FIG. 3. Besides the first electrode 1 there are reserve electrodes 3' provided in an exchange holding means 18 in the pressure vessel 5, whereby it is possible to melt off further electrodes 3' after the first electrode 3 has been consumed. The mould has a lowerable bottom 15, which is moved via the lowering rod 17 guided through the stuffing box 16. Here the ingot 13, depending on its solidification, is downwardly extracted from the mould.

The lowerable bottom can also be used together with a single electrode, or the multiple-electrode-arrangement can be used in connection with a fixed bottom.

The method according to the invention is explained in more detail by the following examples:

EXAMPLE 1

A nitrogen-alloyed steel of the 18/8-type was produced. The ingot had a diameter of 500 mm, a length of 1300 mm and a weight of 2 metric tons. The charge was calculated in the following manner:

| | | chromium | nickel | iron | nitrogen | total |
|---|---|---|---|---|---|---|
| jacket | % | 1.7 | 5.3 | 93 | 0 | 100 % |
| (75 %) | kg | 25 | 80 | 1394 | 0 | |
| core | % | 66.8 | 0 | 30 | 3.2 | 100 % |
| (25 %) | kg | 335 | 0 | 150 | 16 | |
| ingot | % | 18 | 4 | 77.2 | 0.8 | 100 % |
| (100 %) | kg | 360 | 80 | 1544 | 16 | |

The ferro-chromium of the core had a density of 7.1 kg/dm³. This results in a volume of 70.4 dm³. The jacket had a density of 7.8 kg/dm³ and thus a volume of 192 dm³. For this charge a diameter ratio (ingot : electrode) of 0.7 was assumed. From this (500 × 0.7) an electrode diameter of 350 mm, and an electrode area of 9.62 dm² resulted.

The volume of the electrode amounted to 262 dm³ (70.4 + 192). The electrode length resulted from area and volume as being 2.73 m.

The core area resulted from the core volume and the electrode length (70.4 dm³ : 27.3 dm) and was 2.58 dm², and from this a core diameter of 182 mm resulted.

The production was carried out in the following manner: In a usual furnace of a steel making plant an alloy having 67% chromium, 3.2% nitrogen, balance iron and steel companions was molten from a commercial ferro-chromium suraffine having 3.2% nitrogen, and thereupon a bar of ϕ 182 × 2730 mm, 500 kg, was cast. This bar was inserted into the mould for the jacket as core, and the jacket (1500 kg: 1.7% chromium, 5.3% nickel, no nitrogen, balance iron and steel companions) that was melted in the usual manner, was cast around. This electrode was re-melted in an apparatus according to FIG. 1 under a pressure of 31 bar.

The ingot obtained of ϕ 500 × 1300 mm, 2000 kg, was extended by forging to a bar of ϕ 200 × 8100 mm, the two ends were topped to the extent necessary from the point of view of forging technique (1.5 × *d*), i.e., 300 mm, and the bar was divided into 5 pieces of 1500 mm each. At each cut area a transversal disc having a thickness of 20 mm was taken (6 discs).

The discs were etched for macro-segregations, and it showed that the structure was macroscopically homogenous. Thereupon the disc was divided into cubes having an edge length of 10 mm, and the samples were macroscopically examined, also showing a homogenous structure. Thereupon the samples were chemically analysed, and it showed that the discs were homogenous within themselves and among themselves, within the technically tolerable limits. The nitrogen content varied between 0.76 and 0.84%.

EXAMPLE 2

A cap ring steel was produced. The jacket of the electrode consisted of steel and the core consisted of sinter material. First the jacket was made, and then it was filled with nitride powder which was sintered in.

| | | mang-anese | chro mium | iron | nitrogen | total |
|---|---|---|---|---|---|---|
| jacket | % | 9.8 | 0 | 90.2 | 0 | 100 % |
| (65 %) | kg | 128 | 0 | 1180 | 0 | |
| core | | | | | | |
| FeCrN | % | 0 | 67.5 | 27 | 5.5 | 100 % |
| (18 %) | kg | 0 | 240 | 100 | 19.7 | |
| core | | | | | | |
| FeMnN | % | 79.9 | 0 | 17 | 3.1 | 100 % |
| (17 %) | kg | 272 | 0 | 60 | 10.3 | |
| ingot | % | 20 | 12 | 66.5 | 1.5 | 100 % |
| (100 %) | kg | 400 | 240 | 1340 | 30 | |

The FeCrN-powder and the FeMnN-powder were mixed with each other before being filled in. The piled weight was 5.3 kg/dm³, the core volume was 132 dm³. The jacket (7.8 kg/dm³) had a volume of 167 dm³. The calculation was effected in the same manner as in Example 1, and from this resulted an electrode diameter of 350 mm, a core diameter of 232 mm and a length of the electrode of 3.1 *m*.

The further processing was the same as in Example 1, but a pressure of 41 bar (air under pressure) was used. Tests as carried out in Example 1 showed a completely homogenous structure, the nitrogen content varied from 1.45 to 1.54%.

EXAMPLE 3

A valve steel was produced. The jacket consisted of steel, the core was made of a cast mixture of ferro-chromium-nitrogen and ferro-manganese-nitrogen.

Material balance of the charge:

| | | manganese | chromium | nickel | iron | nitrogen | total |
|---|---|---|---|---|---|---|---|
| jacket | % | 0 | 0 | 6.9 | 93.1 | 0 | 100% |
| (58 %) | kg | 0 | 0 | 80 | 1076 | 0 | |
| core | % | 23.6 | 47.2 | 0 | 26.4 | 2.8 | 100% |
| (42 %) | kg | 200 | 400 | 0 | 224 | 24 | |
| ingot | % | 10 | 20 | 4 | 64.8 | 1.2 | 100% |
| (100 %) | kg | 200 | 400 | 80 | 1300 | 24 | |

Material balance of the core casting:

| | manganese | chromium | iron | nitrogen | total |
|---|---|---|---|---|---|
| FeCrN % | 0 | 66.8 | 30 | 3.2 | 100% |
| (70 %) kg | 0 | 400 | 179 | 19.0 | |

| | | mang-anese | chromium | iron | nitrogen | total |
|---|---|---|---|---|---|---|
| FeMnN | % | 80 | 0 | 18 | 2.0 | 100 % |
| (30 %) | kg | 200 | 0 | 45 | 5.0 | |
| core | % | 23.6 | 47.2 | 26.4 | 2.8 | 100 % |
| (100 %) | kg | 200 | 400 | 224 | 24 | |

The core (7.1 kg/dm³) had a volume of 119 dm³. The jacket (7.8 kg/dm³) had a volume of 148 dm³.

There resulted an electrode diameter of 350 mm, a core diameter of 234 mm and an electrode length of 2.8 m.

As in Example 2, 41 bar (nitrogen) were used for the remelting.

The examination showed a homogenous structure. The nitrogen content varied between 1.16 and 1.24%.

What we claim is:

1. In a method of producing homogenous ingots of high-melting, nitrogen-containing alloys having nitrogen contents exceeding the solubility limit at atmospheric pressure by electric slag remelting under a pressure higher than atmospheric pressure, the improvement comprising employing a composite electrode having at least one core consisting essentially of a first nitrogen-containing alloy and a jacket consisting essentially of a second nitrogen-containing alloy, said first nitrogen-containing alloy having a nitrogen content differing from the nitrogen content of said second nitrogen-containing alloy in that one of these nitrogen contents is hgher than the nitrogen content of the ingot to be produced, while the nitrogen content of the respective other nitrogen-containing alloy is lower than that of the ingot to be produced.

2. A method as set forth in claim 1, wherein the at least one core of the composite electrode has a nitrogen content that is higher than the nitrogen content of the ingot to be produced and wherein the jacket of the composite electrode has a nitrogen content that is lower than the nitrogen content of the ingot to be produced.

3. A method as set forth in claim 1, wherein the jacket of the composite electrode has a nitrogen content that is higher than the nitrogen content of the ingot to be produced and wherein the at least one core of the composite electrode has a nitrogen content that is lower than that of the ingot to be produced.

4. A method as set forth in claim 1, wherein a composite electrode is employed that comprises a plurality of cores.

5. A method as set forth in claim 4, wherein the cores have nitrogen contents differing from one another.

6. A method as set forth in claim 1, wherein the pressure higher than the atmospheric pressure is produced by a gas that has a poor solubility in the slag.

7. A method as set forth in claim 6, wherein said gas is selected from the group consisting of nitrogen, argon and dry air.

8. A method as set forth in claim 1, wherein the at least one core of the composite electrode is cast into the jacket.

9. A method as set forth in claim 1, wherein the jacket of the composite electrode is cast to surround the at least one core.

10. A method as set forth in claim 1, wherein the at least one core of the composite electrode is produced by filling alloy particles into the jacket.

11. A method as set forth in claim 10, wherein the alloy particles are sintered.

12. A method as set forth in claim 1, wherein the jacket of the composite electrode is produced of individual alloy particles by sintering.

13. A method as set forth in claim 12, wherein the composite electrode is surrounded by a sheet casing.

14. A method as set forth in claim 1, wherein the at least one core is produced by sintering in a separate mould each and then the jacket is cast therearound.

15. A method as set forth in claim 1, wherein the at least one core is produced by sintering in a separate mould each and the jacket is made of individual alloy particles by sintering.

16. A method as set forth in claim 15, wherein the jacket is surrounded by a sheet casing.

17. A method as set forth in claim 1, wherein the jacket is made of individual alloy particles by sintering and wherein the at least one core of the composite electrode is produced by filling alloy particles into the jacket.

18. A method as set forth in claim 17, wherein the jacket is surrounded by a sheet casing.

19. A method as set forth in claim 17, wherein the alloy particles filled into the jacket to form the at least one core of the composite electrode are sintered.

* * * * *

UNITED STATES PATENT OFFICE

CERTIFICATE OF CORRECTION

Patent No. 4,027,720 Dated June 7, 1977

Inventor(s) Erwin Plöckinger, Otto Daghofer, Farouk Barakat

It is certified that error appears in the above-identified patent and that said Letters Patent are hereby corrected as shown below:

Page 1, in the heading after "Assignee": delete "Vereinigte Edelstahlwerke AG," and insert therefor --Vereinigte Edelsthalwerke Aktiengesellschaft (VEW)--

Column 6, line 11, delete "hgher" and insert therefor --higher--

Signed and Sealed this

Fourth Day of October 1977

[SEAL]

Attest:

RUTH C. MASON
Attesting Officer

LUTRELLE F. PARKER
Acting Commissioner of Patents and Trademarks